United States Patent [19]

Tyler et al.

[11] Patent Number: 4,630,216

[45] Date of Patent: Dec. 16, 1986

[54] METHOD AND APPARATUS FOR CONTROLLING AND MONITORING MOVEMENT OF MATERIAL-TRANSPORTING CARRIAGES

[75] Inventors: Tommy N. Tyler, Broomfield; John W. Harvey, Aurora, both of Colo.

[73] Assignee: Translogic Corporation, Denver, Colo.

[21] Appl. No.: 617,348

[22] Filed: Jun. 5, 1984

[51] Int. Cl.[4] ..... G06F 15/46; B62D 1/24; B65J 47/10

[52] U.S. Cl. ..... 364/478; 104/88; 180/168; 198/341; 198/349; 198/358; 235/375; 364/468

[58] Field of Search ..... 364/468, 469, 478, 479; 104/88; 414/134–136; 198/340, 341, 349, 356, 358; 235/375; 180/168

[56] References Cited

U.S. PATENT DOCUMENTS

| | | | |
|---|---|---|---|
| 3,340,821 | 9/1967 | Wesener | 104/88 |
| 3,803,556 | 4/1974 | Duffy | 198/349 X |
| 3,933,099 | 1/1976 | Sieb | 104/88 |
| 4,053,741 | 10/1977 | Ainoya et al. | 364/478 |
| 4,168,760 | 9/1979 | Paul, Jr. et al. | 104/88 X |
| 4,215,759 | 8/1980 | Diaz | 104/88 X |
| 4,473,883 | 9/1984 | Yoshida et al. | 364/468 X |

OTHER PUBLICATIONS

"Ralfs Also Has the Correct Document Conveyor System for You", by Ralfs Einrichtungs-GmbH.

"Ralfs Hat Auch Fur Sie Das Richtige Fordersystem", by Ralfs.

*Primary Examiner*—Joseph Ruggiero

*Attorney, Agent, or Firm*—Sheridan, Ross & McIntosh

[57] ABSTRACT

A computer-controlled conveying system is provided for use in transporting materials between different locations. The system includes a plurality of carriages for receiving and holding the materials and a track along which the carriages move in transporting the materials. Each of the carriages has a unique identifier, which is used by a system controller to monitor and control the movement of the carriage. A number of transfer units, and corresponding transfer unit controllers, are provided along the track. The transfer unit controllers communicate with a system controller and, in conjunction with the transfer units and information received from the system controller, act to provide the desired path for end of the carriages.

38 Claims, 15 Drawing Figures

| TRANSFER UNITS | 22a | 22b | 22c | 22d | 22e | 22f | 22g | 22h | 22i |
|---|---|---|---|---|---|---|---|---|---|
| STATION A | 1 | 0 | | | | 1 | | | |
| STATION B | 3 | 0 | | | | 1 | | | |
| STATION C | | | | 3 | | 1 | | | |
| STATION D | | | | | | | | | |
| STATION E | | 0 | | | | 1 | 2 | | |
| STATION F | | 0 | | | | 1 | | 2 | |

110

METHOD AND APPARATUS FOR CONTROLLING AND MONITORING MOVEMENT OF MATERIAL-TRANSPORTING CARRIAGES

FIELD OF THE INVENTION

The present invention relates to computer controlled conveying systems and, in particular, to a system for controlling and monitoring a plurality of carriages as they move along a track.

BACKGROUND INFORMATION

In relatively large office buildings, including hospitals, it is beneficial to be able to transport various materials or articles from one location to another with maximum efficiency. To accomplish such an objective, conveying systems have been previously developed which include tracks and carriages or cars which move along the tracks. The cars are designed for receiving and holding small articles which are transportable from one station located near one section of the track to another station located near another section of the track.

From previously developed conveying systems, it is known to control the movement of cars along a main track so that they can be transferred to branches of the track for receipt by a station adjacent to one of the branches. In such systems, each of the cars is given a destination address by the user and means are provided adjacent to the interconnection between the main track and the branch for determining whether the car has reached its desired station or destination.

In one known computer-controlled conveying system, a main processor is linked to each of a number of movable trolleys which support containers. The trolleys themselves include microprocessors which communicate with the main processor and each trolley microprocessor is able to store the destination address of its accompanying container so that the system is able to transport the trolley to its desired destination.

SUMMARY OF THE INVENTION

The present invention is a computer-controlled conveying system having a number of carriages for use in transporting various kinds of articles from sending stations to receiving stations. The system includes a main track for transporting the carriages between stations. Branches from the main track are provided at the stations for transporting carriages between the main track and the sending or receiving station.

A number of transfer units or switching devices are provided along sections of the main track. Each transfer unit is defined as including four ports and also has a section of movable track. The four ports are connection points at which the movable track can be aligned with fixed sections of the main track or the track branch. The movable track is used to provide a link or interconnection between the main track and the track branch. The movable track can be moved into two separate positions. In the first position, the movable track forms a part of the main track, while in a second position, the movable track forms a part of the track branch.

Each transfer unit communicates with a transfer unit controller. The transfer unit controllers communicate with a system controller, which provides the controlling and monitoring functions associated with the present invention. Also communicating with the system controller through the transfer unit controllers are station control units, which are located adjacent to the track branches and are found at the various stations for sending and receiving carriages. To permit the monitoring and controlling of the movement of the plurality of carriages by the system controller, each carriage is given a separate and unique carriage identifier.

In operation, the user of the system inputs a receiving address for the station to which a carriage is to be transported over the main track. Using this receiving or destination address, together with the carriage identifier, the system controller is able to control the movement of the carriage along a desired track path. As the carriage reaches a transfer unit in its path, the transfer unit controller in communication with that transfer unit, using the information received from the system controller and stored by the transfer unit controller, acts to position the movable track of the transfer unit in the desired position so that the carriage continues to move along the desired or predetermined path. In that regard, the transfer unit controller determines the identifier associated with the carriage, and using the identifier, determines the desired position of the movable track. Upon reaching the transfer unit associated with the track branch for the receiving station, the transfer unit controller acts to position the movable track so that the carriage is transported to the track branch and is then received at the destination station having the previously given receiving address.

In addition to the primary task of controlling the movement of carriages from sending stations to receiving stations using a car identifier, the system controller, working with the appropriate transfer unit controllers, provides a number of other features, which are important to system operation. In particular, the system controller acts to prevent carriages from being dispatched from a sending station if the receiving station is not available. The system controller acts to automatically change the path of a vehicle while it is in transit, if the receiving station is not available to receive the carriage. The system controller also acts to monitor the approximate location of each of the carriages during its movement along the track. The system controller further acts to monitor the time that the carriage spent in transit in the system, from the time it was dispatched from a sending station. Relatedly, the system controller monitors the total time that each carriage has been used in the system. The system controller also acts to provide carriages to each station so that the station has a sufficient number of cars for use. The system controller additionally acts to transport empty carriages, or carriages whose identities cannot be determined, to designated stations.

Based on the foregoing description, a number of advantages of the present invention are readily seen. A computer-controlled conveying system is provided which efficiently transports each of a plurality of carriages to its desired destination. In carrying out this operation, the present invention uses carriages having unique identifiers so that the movement of each of the cars can be controlled using the given identifier. Because a car identifier is used, hardware used in controlling the movement of the carriages is readily substitutable, and inexpensively installed. Additionally, the present invention displays information and monitors associated events relating to the movement of numerous carriages to different destinations so that the user of the system is informed regarding the destinations of the various carriages, as well as their present locations and transit times in the system.

Additional advantages of the present invention will become readily apparent from the following discussion, when taken in conjunction with the accompanying drawings.

DETAILED DESCRIPTION OF THE INVENTION

Figure 1:
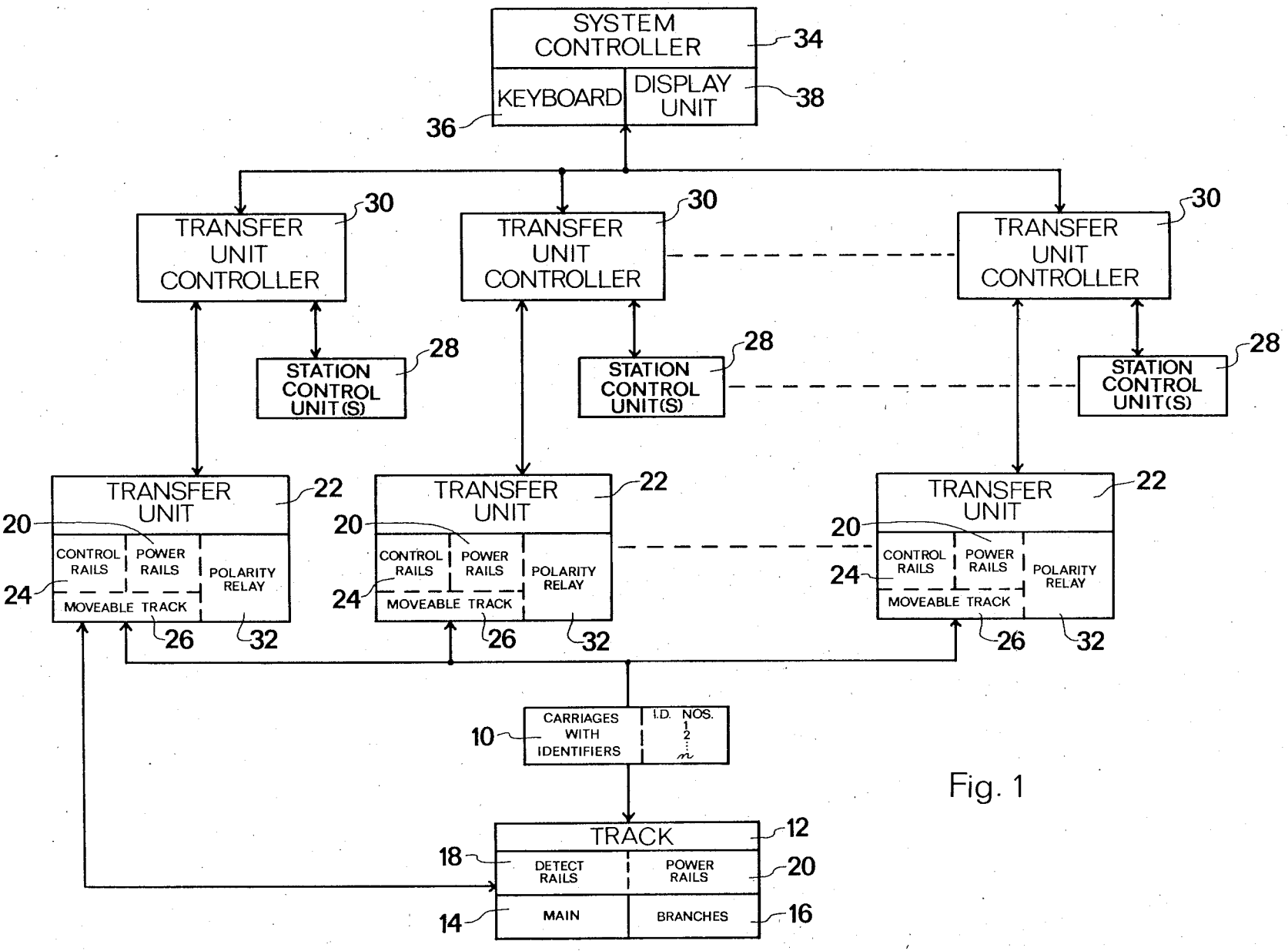
FIG. 1 is a block diagram of the conveying system of the present invention.

In accordance with the present invention, and with initial reference to FIG. 1, a computer-controlled conveying system is provided for transporting materials held by carriages or cars 10 over a track 12 between sending and receiving addresses. Each of the cars 10 is provided with its own unique identifier or identification number to distinguish it from each of the other cars 10. The track 12 includes main track 14 which forms the primary portion or loop along which the cars 10 move to track branches 16. Both the main track 14 and the track branches 16 comprise detect rails 18 and power rails 20. The proper voltage is supplied to the power rails 20 and applied to a motor for each car 10 on the track 12 to enable the cars 10 to move along the track 12. The detect rails 18 are used in reading the identification number or detecting the presence of a car 10 on the track 12. The detect rails 18 can be located at predetermined locations along the track 12 and are used to monitor the approximate locations of the cars 10.

The system also includes a number of transfer units 22, which are located at predetermined, desired positions along the track 12. The transfer units 22 are basically switching devices for transporting cars 10 between the main track 14 and the track branches 16. The transfer units 22 can also be used in changing the direction of cars 10 along the main track 14. Each transfer unit 22 includes control rails 24 and a section of movable track 26.

The control rails 24 of the transfer units 22, like the detect rails 18, include rails for reading the identification numbers of cars 10 and rails for detecting the presence of cars 10. Additionally, the control rails 24 include rails for use in stopping movement of the cars 10.

The movable track 26 is located at one of two positions relative to the main track 14 and the track branches 16. In a first position, the movable track 26 is located between two ports or connection points in which the movable track is aligned with the fixed main track 14. In a second position, the movable track 26 is located between two other ports or connection points in which the movable track is aligned with a fixed track branch or branches 16. For control purposes, in the preferred embodiment, the ports are given identification numbers 0–3, and if the movable track 26 is aligned with ports 0 and 2 it is in the even position, and if the movable track 26 is aligned with ports 1 and 3 it is in the odd position.

The system further includes a number of station control units 28 located at car receiving and sending stations for use in sending and receiving cars 10 between such stations. Associated with station control unit 28 for identifying the same is a station address. The user of the conveying system utilizes a car 10 located at one station control unit 28 to send material to another station having an associated station control unit 28. Each station control unit 28 is typically located adjacent to a track branch 16. In the preferred embodiment, at least two kinds of stations are utilized, namely, reversing stations and through stations. A reversing station is a station in which cars 10 are able to move to and from the station along the same section of track branch 16. As a consequence, a car 10 last entering a reversing station must be the first to exit that station. A through station is a station in which cars can move only in one direction along the track branch 16 so that the cars 10 are processed on a first-in-first-out basis. In connection with reversing stations, only one car 10 can be received or sent at the same time by the same station, while a through station permits a car 10 to be received into the station at the same time another car 10 is being sent therefrom. In the preferred embodiment, at least some of the transfer units 22 can host or be connected to two, rather than one, station for sending and receiving cars 10.

The conveying system additionally includes a number of transfer unit controllers 30. Each transfer unit controller 30 is in communication with an associated or corresponding transfer unit 22. The transfer unit controller 30 is used in monitoring and controlling the operation of the associated transfer unit 22 and its movable track 26, and is also used in monitoring the control rails 24 associated therewith.

In controlling a transfer unit 22, the associated transfer unit controller 30 causes movement of the movable track 26 by energizing a motor within the transfer unit 22 that drives a reciprocating mechanism until limit switches indicate to the transfer unit controller 30 that the movable track 26 is at the desired location. Relatedly, a polarity relay 32 is included in each transfer unit controller 30 for controlling the polarity of the power rails 20 located on the movable track section 26. Energizing the polarity relay 32 causes movement of a car 10 on the movable track 26 in one direction, while de-energization of the polarity relay 32 causes movement of a car 10 in the opposite direction. In monitoring the transfer unit 22, the associated transfer unit controller 30 receives inputs provided by the control rails 24.

Each transfer unit controller 30 may also be in communication with one or two of the station control units 28, which are associated with the station or stations to and from which the corresponding transfer unit 22 sends and receives cars 10. The transfer unit controllers 30 are informed as to the identity of the port numbers to which an associated station is connected by means of programmable switches. Similarly, programmable switches are used to inform the transfer unit controllers 30 as to whether an associated station is a through station or a reversing station. This information will be used to determine the steps to be taken in controlling movement of a car 10 between the station and its connected transfer unit 22.

The overall control of the conveying system is provided by a system controller 34 which communicates with each of the transfer unit controllers 30. The system controller 34 includes a software-instructed digital processor and memory, as well as a keyboard 36 for inputting data and information to the memory, and a display unit 38 for providing a visual display of desired information associated with the movement of the cars 10. The system controller 34 is used to provide information to the various transfer unit controllers 30 so that a car transaction, i.e. movement of a car 10 from a sending station to a receiving station along a desired path, is efficiently accomplished, even with a large number of cars 10 in transit through the system.

In preparation for proper control by the system controller 34, the system controller 34 is programmed with numerous system configuration details. For each transfer unit controller 30, the system controller 34 is provided with an address to identify it. For each of the associated transfer units 22, the system controller 34 is also provided with the identification number of a standard entry (SE) port and a standard exit (SX) port. The SE port is generally that port facing a main traffic line for the cars 10 on the main track 14 and which also defines the standby or rest position of the movable track 26. The SX port is that port which faces in the direction of main traffic flow and is that port which all cars 10 exit unless route instructions are provided identifying another exit port to be taken by the car 10.

Figure 2:
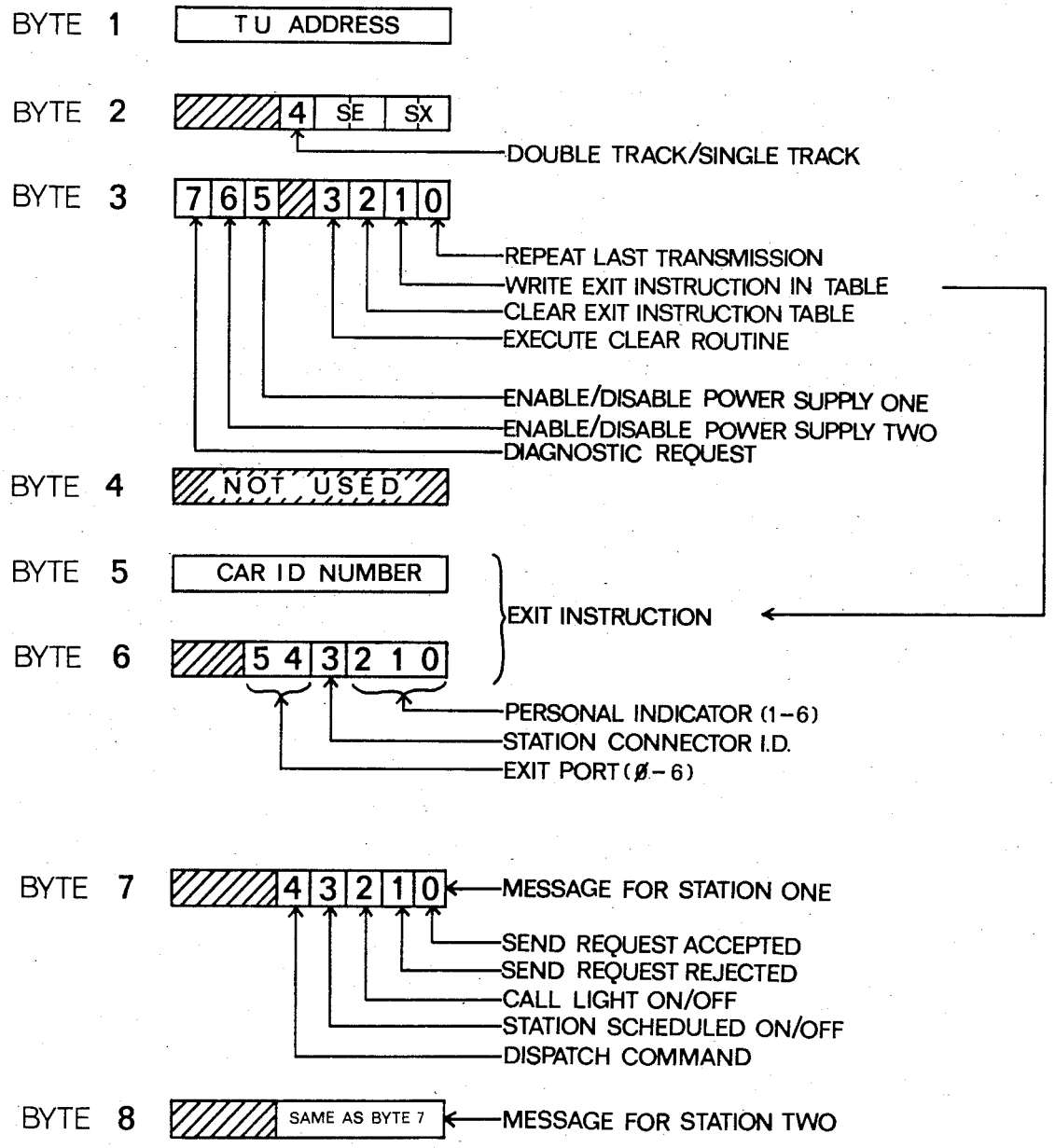
FIG. 2 illustrates a polling message format used in transmitting information from the system controller to transfer unit controllers.

In determining the appropriate control to be exercised and to receive necessary data associated with monitoring the cars 10, the system controller 34 sends a polling message to each of the transfer unit controllers 30 in a serial manner. The polling message format from the system controller 34 to the transfer unit controllers 30 is illustrated in FIG. 2. As can be seen from FIG. 2, the system controller 34 sends a number of bytes of information. The first byte contains the address of the transfer unit controller 30, and its associated transfer unit 22, to which the remaining bytes of information are applicable. The second byte provides the identity of the ports which are the standard entry and the standard exit ports for that transfer unit 22 having the address in the first byte. Byte 3 is used by the system controller 34 to request information from the transfer unit controllers 30, and is also used to control certain operations associated therewith. Byte 5 includes the identification number of one of the cars 10 which has been placed in the conveying system and the system controller 34 is informing the identified transfer unit controller 30 of the identification number of this particular car 10. Byte 6 relates to byte 5 in that the transfer unit controller 30 identified in byte 1 is instructed regarding the exit port number to be taken by the car 10 having the identification number provided in byte 5 when that car reaches the transfer unit 22 associated with the transfer unit controller 30 identified in byte 1. Bytes 7 and 8 also relate to providing status or control information to the transfer unit controllers 30. Two different bytes are provided because each transfer unit controller 30 may, as previously discussed, communicate with two station control units 28, and the information provided in byte 7 relates to one of the two station control units 28, while that in byte 8 relates to the other of the two station control units 28.

Figure 3:
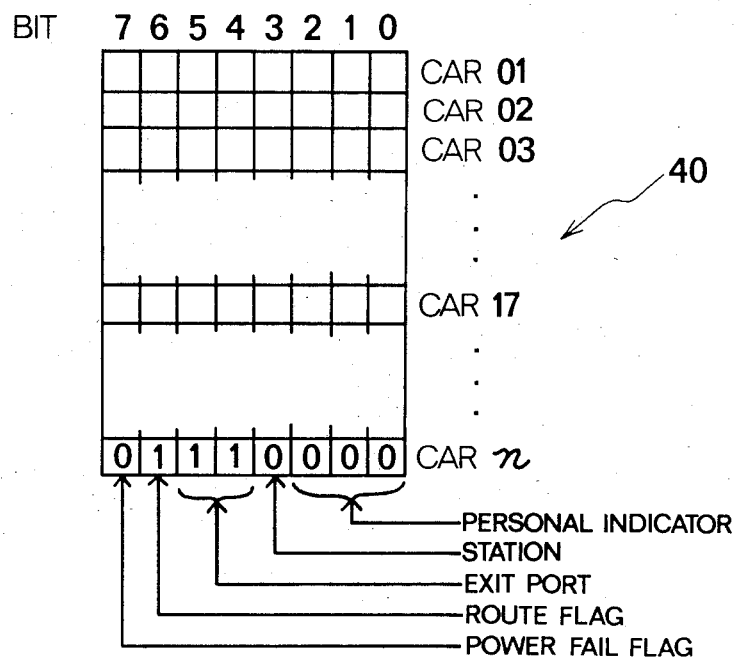
FIG. 3 illustrates an exit route instruction table for a transfer unit controller.

In connection with the sending of the identification numbers of the cars 10, each transfer unit controller 30 has an exit route instruction table 40 provided in its memory with a memory location being provided for each car 10 which can be used in the system. With reference to FIG. 3, it is seen that each memory location associated with a particular car 10 has 8 bits. Bits 4 and 5 identify the exit port to be taken by the particular car associated with that memory location. For example, with regard to a transfer unit controller 30 having the memory shown in FIG. 3, car n has an exit port of 3. Consequently, unless changed by the system controller 34, when car n comes into the control area for the transfer unit controller 30 having the route instruction table 40 of FIG. 3, car n will exit out of port 3 of the corresponding transfer unit 22.

Figure 4:
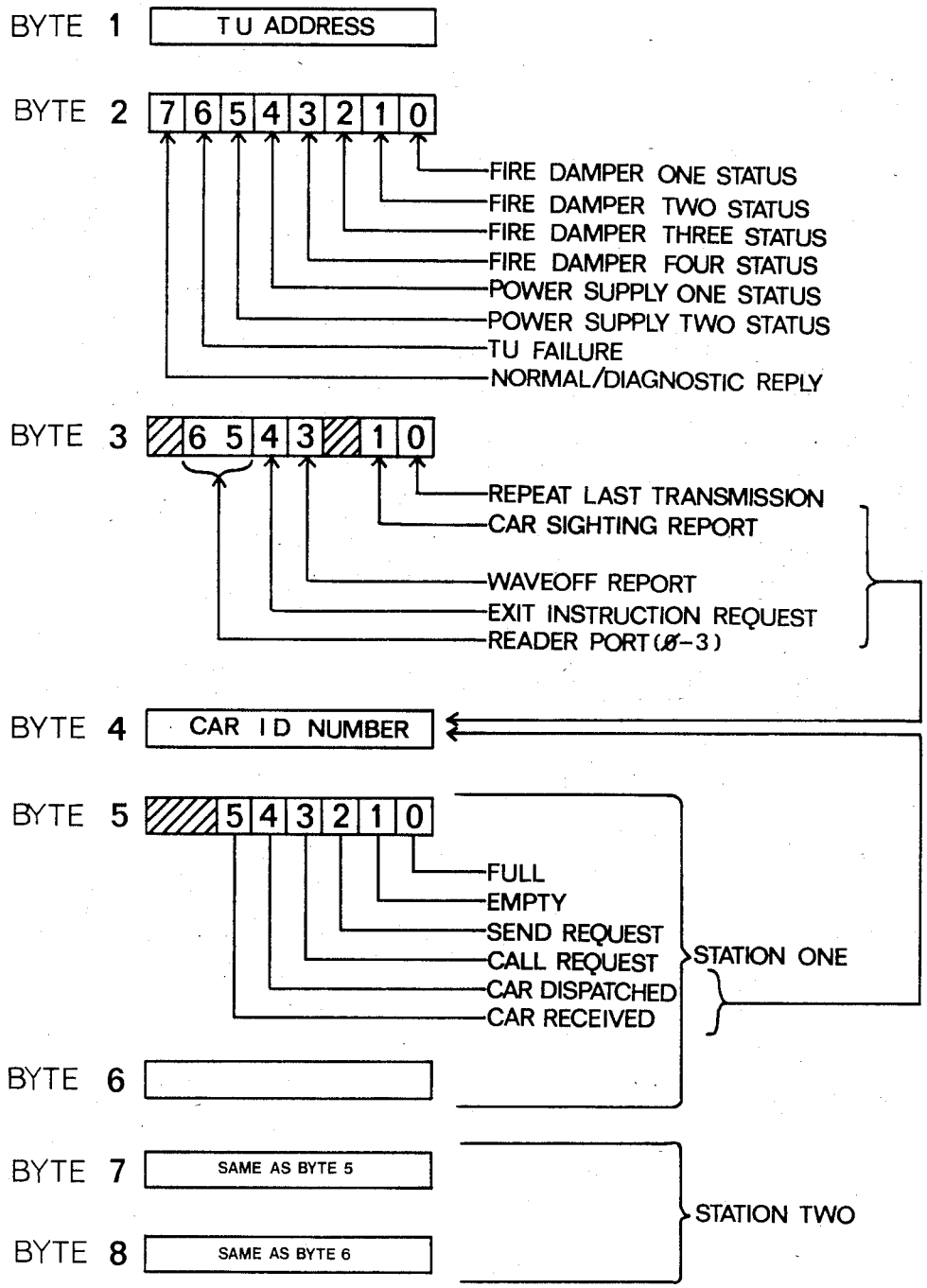
FIG. 4 illustrates a polling reply format for transmitting information from a transfer unit controller to the system controller.

Whenever a transfer unit controller 30 is polled by the system controller 34, the transfer unit controller 30 reponds back to the system controller 34 with its own polling reply. FIG. 4 illustrates the polling reply format of a transfer unit controller 30. As can be seen, the polling reply includes 8 bytes of information. The first byte identifies the address of the transfer unit controller 30 and the associated transfer unit 22 providing the reply. Byte 2 provides information relating to the monitoring of predetermined events or status information relating to the transfer unit 22. Byte 3 provides information to the system controller 34 concerning the entry of a car 10 into the control area of the transfer unit controller 30. Byte 4 provides the identification number of a car 10 and, in the case of a car sighting, for example, is used with byte 3 to provide this information to the system controller 34. Bytes 5 and 6 include information concerning the sending and/or receiving of a car 10 at a station controlled by the particular transfer unit controller 30. In connection with the sending of a car 10, byte 6 contains the destination or receiving address of the car 10 which is to be dispatched, while byte 4 contains the identification number of the dispatched car 10. For any one polling reply, byte 4 information is used in conjunction with byte 3 or bytes 5 and 6, but not both. Because the transfer unit controller 30 may control two station control units 28, rather than one, bytes 7 and 8 are used, instead of bytes 5 and 6, to provide information for a second station control unit 28 when the information in the reply relates to that unit 28 and not the other of the two station control units 28.

Figure 5:
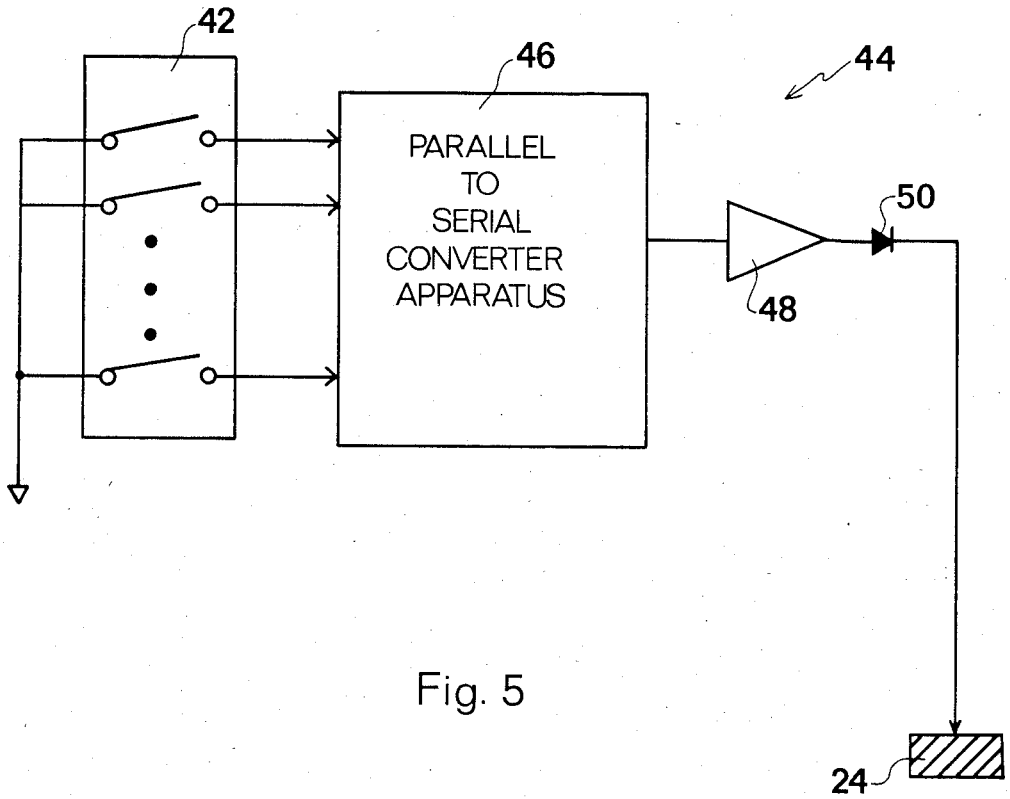
FIG. 5 is a schematic of the transmitter circuit of a carriage.

The ability of the system to determine the identity of a car 10 while it is in contact with a control rail 24 is discussed in more detail with reference to FIGS. 5 and 6. Each of the cars 10 to be used in the conveying system is provided with a programmable switch 42, which is part of a car transmitter circuit 44. In one embodiment, the programmable switch 42 is used to provide an eight bit binary identification number so that, in such a case, a conveying system could handle 256 cars, with each having a different identification number. The output of the programmable switch 42 is applied to a parallel-to-serial converter apparatus 46. In one embodiment, the converter apparatus 46 converts the received parallel bit pattern to a number of data pulses, together with accompanying identifying information in the form of logic levels. That is, each of the data pulses of the serial bit pattern represents one of the bits provided by the programmable switch 42 while a logic high level and a logic low level are provided on opposite sides of each data pulse to indicate the presence thereof. The output from the converter apparatus 46 is applied to a driver amplifier 48. The output from the amplifier 48, in one embodiment, is a signal having about a 6 volt peak. This signal is applied to the diode 50 and sent to a control rail 24 when the car 10 comes in contact therewith.

Figure 6:
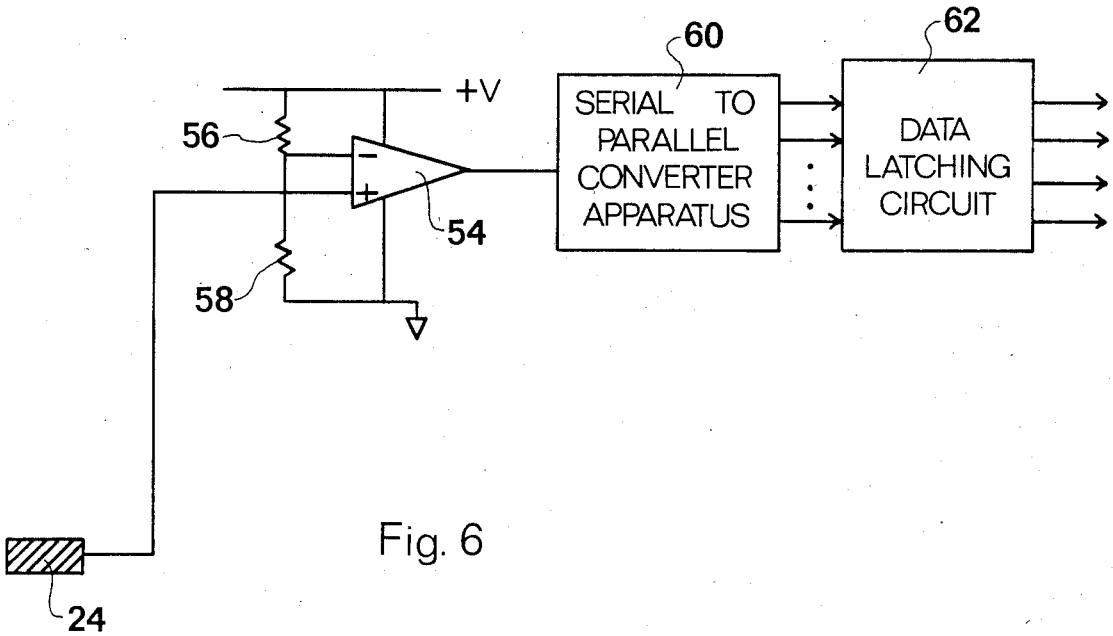
FIG. 6 is a schematic of a reader circuit of a transfer unit controller.

The control rail 24 is also in communication with a transfer unit controller 30, as illustrated in FIG. 6. When a car 10 comes into contact with a control rail 24 associated with a particular transfer unit controller 30, then the amplified serial bit pattern is transmitted from the control rail 24 to a reader circuit 52 in the transfer unit controller 30. The reader circuit 52 includes a comparator amplifier 54. In the embodiment shown, the inverting input of the amplifier 54 is biased, using resistors 56, 58, such that a voltage level of about 4 volts is inputted thereto. Since the output of the transmitter circuit 44 is a signal having an amplitude of about 6 volts, the signal outputted therefrom (transmitter signal) exceeds the 4 volt bias level of amplifier 54 so that the serial bit pattern from the transmitter circuit 44 is amplified by the amplifier 54 and inputted to a serial to parallel converter apparatus 60. The converter apparatus 60 converts the serial bit pattern back to the parallel bit pattern outputted by the programmable switch 42 of the transmitter circuit 44. The output of the converter apparatus 60 is applied to a data latching circuit 62 for use in transferring the car identifying information or number to the transfer unit controller 30. The serial-to-parallel converter apparatus 60 and the data latching circuit 62 are under the control of the transfer unit controller 30 to provide outputs therefrom. Additionally, the appropriate transfer unit controller 30, using the car identification number just read, is able to access its exit instruction table 40 to determine the exit to be taken by the identified car 10 from the corresponding transfer unit 22.

Figure 7:
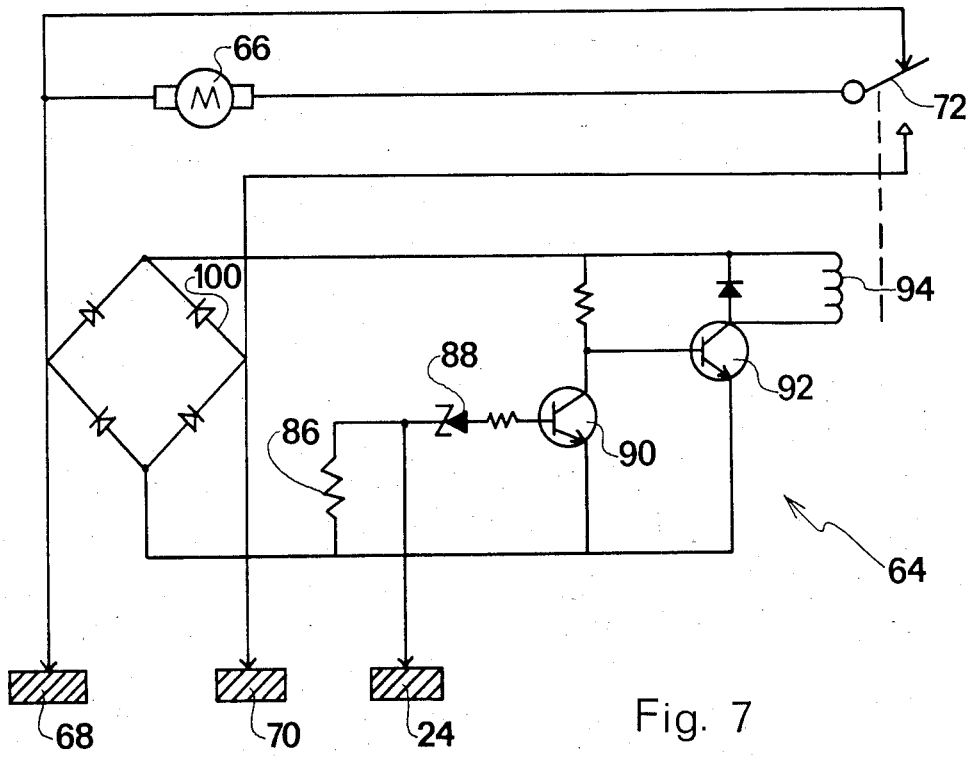
FIG. 7 is a schematic of a car drive control circuit of a carriage.

In addition to the car identifying transmitter circuit 44, each car 10 also includes a drive control circuit 64. With reference to FIG. 7, it is seen that the drive control circuit 64 includes a motor 66 being electrically connected to the power rails 20 by means of sliding contact brushes. The power rails 20 include two spaced rails 68, 70 with the rails 68, 70 being at different voltage potentials so that, when the motor 66 is electrically connected between the two rails 68, 70, the motor 66 drives the car 10. The car drive control circuit 64 also includes a relay switch 72. When the relay switch 72 is in a first position whereby an electrical connection is provided between the output of the rail 70 and the motor 66, the motor 66 receives power and the car 10 is able to move. Conversely, when the relay switch 72 is in its second position providing an electrical connection or short between the two motor inputs, there is no power to the motor 66, and car 10 stops moving.

Figure 8:
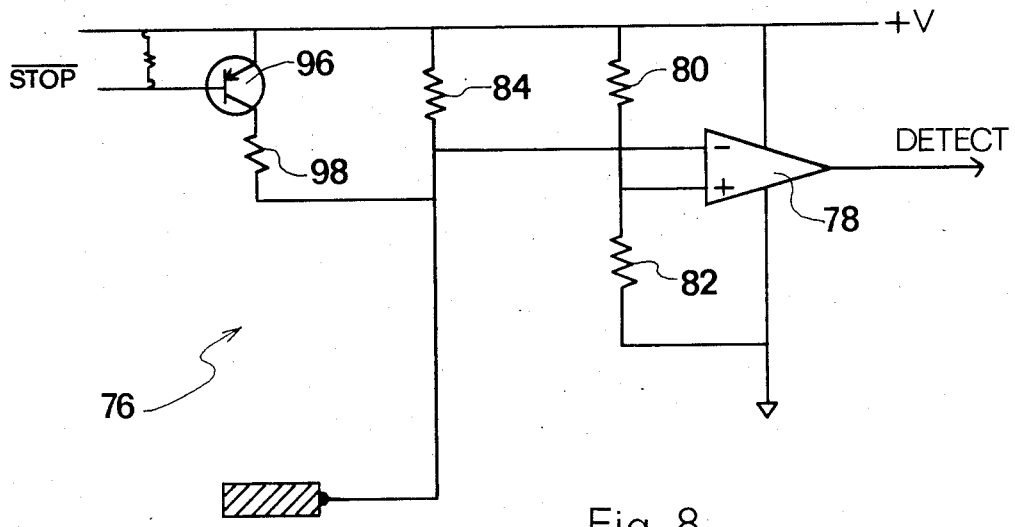
FIG. 8 is a schematic of a car detecting and controlling circuit of a transfer unit controller.

In connection with the controlling of the relay switch 72, reference is made to FIG. 8, which illustrates a car detecting and controlling circuit 76. The detecting and controlling circuit 76 includes a comparator amplifier 78, which has its non-inverting input biased by resistors 80, 82. In the embodiment shown in FIG. 8, the biasing voltage inputted to the non-inverting input is about 22 volts. The inverting input to the amplifier 78 is the output from the voltage divider made up of an input from a control rail 24 and the resistor 84. When no car 10 is present on the control rail 24, the signal to the inverting input of the comparator amplifier 78 is essentially 24 volts, which is greater than the input to the non-inverting input of the amplifier 78. As a result, a logic low is outputted by the amplifier 78. When a car 10 is present on the control rail 24, the internal resistance 86 (see FIG. 7) of the car 10 changes the voltage to the inverting input of the amplifier 78 to about 2 volts, in the case of the internal resistance 86 of the drive control circuit 64 of the car 10 being about 8.2K ohms and the resistor 84 being about 100K ohms. As a consequence, the output of the amplifier 78 becomes a logic high indicating to the transfer unit controller 30 that a car 10 has been detected on the control rail 24.

In addition to be being used to detect the presence of the car 10, the voltage on the control rail 24 due to the presence of the car 10 is also applied to the car drive control circuit 64 and is inputted to the zener diode 88. Since the voltage level of the control rail 24 is about 2 volts when a car 10 is detected, the zener diode 88, which has a breakdown voltage rating of about 12 volts, does not conduct so that transistor switch 90 remains in its off state. Because transistor switch 90 is off, transistor switch 92 is turned on to provide a current path through the relay coil 94 thereby energizing the same and causing the switch 72 to be in its first position whereby power is supplied to the motor 66.

To stop the car 10, the transfer unit controller 30 provides a stop signal to the base of transistor 96 in the car detecting and controlling circuit 76. This signal turns on the transistor 96 so that the resistor 98 and the internal resistance 86 of the drive control circuit 64 of the car 10 act as a voltage divider whereby, in the embodiment shown, 19 volts is applied to the zener diode 88. This magnitude of voltage causes the zener diode 88 to conduct thereby turning on the transistor switch 90 and, conversely, turning off the transistor switch 92. Since transistor switch 92 is turned off, the relay coil 94 is de-energized causing the relay switch 72 to be in its second position in which the motor 66 is shorted out so that the movement of the car 10 stops.

A rectifier bridge circuit 100 is also provided in the car drive control circuit 64 to maintain the correct polarity for the drive control circuit 64, regardless of the polarity of the power rails 68, 70.

It is also understood that the transmitter circuit 44 does not interfere with the operation of either the car drive control circuit 64 or the car detectlng and controlling circuit 76. Since the output of the transmitter circuit 44 is a signal having an amplitude of about 6 volts, this signal is of insufficient amplitude to cause conduction of zener diode 88, and consequently relay coil 94 remains energized and relay switch 72 connects voltage from power rail 70 to motor 66. When the car 10 is being stopped by a stop signal and with the subsequent turning on of the transistor switch 96, diode 50 is back-biased by voltage on the control rail 24, and this prevents the output circuit of amplifier 48 from placing an impedance on the control rail 24 that might cause the voltage thereon to fall below the level required to cause zener diode 88 to conduct. As a consequence, while the car 10 is stopped on a control rail 24 the identification number of the car 10 cannot be determined. In the present invention, however, the transfer unit controller 30 is so devised that it is not necessary to read the identity of a stopped car 10.

It is also noted that, when the transistor switch 96 is being turned on by a stop signal from the transfer unit controller 30, the inverting input to the amplifier 78 (19 volts) is still less than the input to the non-inverting input (22 volts) so that a logic high detect level is still being received by the transfer unit controller 30 during the time that the car 10 is stopped in contact with the control rail 24 thereby providing an indication of the presence of a car 10.

Figures 9, 11:
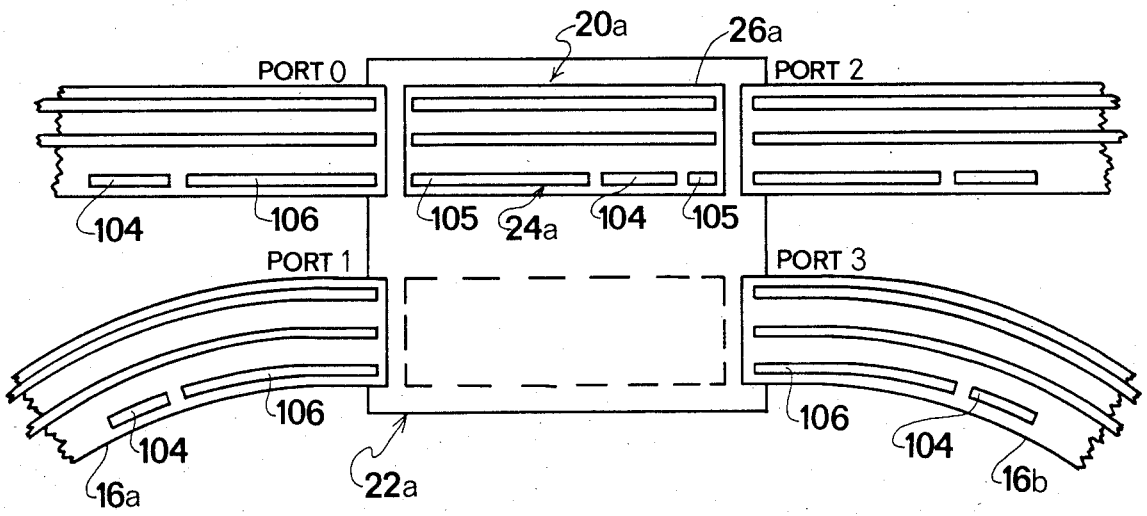
FIG. 9 is an enlarged schematic illustration of a transfer unit.
FIG. 11 is a route matrix stored in the memory of the system controller used in conjunction with the embodiment illustrated in FIG. 10.

A representative transfer unit 22*a* is shown in more detail in FIG. 9. As can be seen, the transfer unit 22*a* includes the four ports 0–3. A car 10 enters one of the four ports and then exits one of the remaining three ports on its way to its destination. As previously described, in connection with the setting up of the control of the conveying system, one port of the transfer unit 22*a* is selected as a standard entry (SE) port while another port is selected as a standard exit (SX) port. In the case of FIG. 9, assuming movement of cars 10 from left to right, port 0 is chosen as the SE port and port 2 as the SX port.

The transfer unit 22*a* further includes a section of movable track 26*a*. As illustrated in FIG. 9, the movable track 26*a* is positioned between the SE port 0 and the SX port 2, which interconnects portions of the main track 14. When a car 10 is to move to or from a track branch 16*a* or 16*b*, the movable track 26*a* is moved to the position outlined by the phantom lines so that the track branches 16*a*, 16*b* are linked together.

Provided on the movable track 26*a* are the control rails 24*a*. The control rails 24*a* include a stop/detect rail 104, which can be used in both stopping a car 10 and detecting its presence. The stop/detect rail 104 on the movable track 26*a* is located between a pair of detect rails 105, which are used in detecting the presence of a car 10 while it is on the movable track 26*a*, except when the car 10 is on the stop/detect rail 104 located on the movable track 26*a*. As a result, the control rails 24*a* are able to inform the transfer unit controller 30 as to the presence of the car 10 during its entire movement on the movable track 26*a* and, using the stop/detect rail 104, a car 10 can be stopped on the movable track 26*a*. After stopping the car 10, the movable track 26*a* can then be moved to its second position (shown by phantom lines) for sending the car 10 to one of the track branches 16*a*, 16*b*.

Also provided in the area of the transfer unit 22*a* are four additional stop/detect rails 104 and four read/-detect rails 106. The read/detect rails 106 are used in both detecting the presence of a car 10 using car detecting and controlling circuit 76 and reading the identification number of a car 10 using the reader circuit 52. One stop/detect rail 104 and one read/detect rail 106 are provided adjacent to each of the four ports of the transfer unit 22*a*. By means of the stop/detect rails 104 located adjacent to each of the ports, the transfer unit controller 30 is able to prevent movement of cars 10 into the transfer unit 22*a* so that, when a car 10 is already being processed by the transfer unit 22*a*, other cars 10 can be stopped. By means of the read/detect rails 106, the transfer unit controller 30 is kept fully informed at all times as to the presence and identification number of the car 10 about to enter or exit the movable track 26*a*.

In conjunction with movement of a car 10 from the movable track 26*a* to one of the track branches 16*a*, 16*b*, the polarity relay 32 of the transfer unit 22*a* acts to provide the desired polarity to the power rails 20*a* of the movable track 26*a* so that the car 10 is able to exit in the selected one of two directions towards track branch 16*a* or 16*b*.

Figure 10:
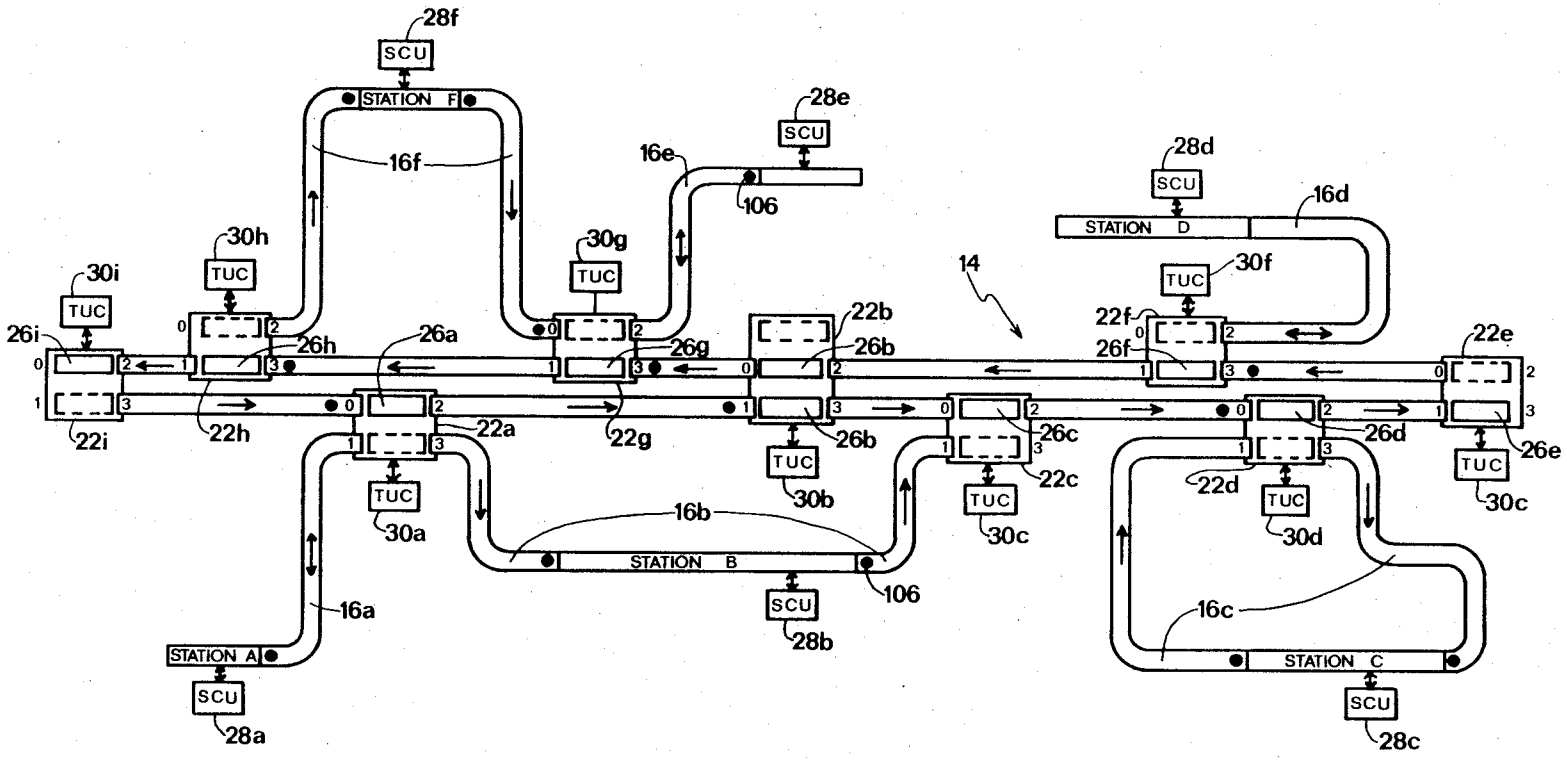
FIG. 10 is a diagrammatic illustration of a conveying system having nine transfer units and six stations.
Figure 12A:
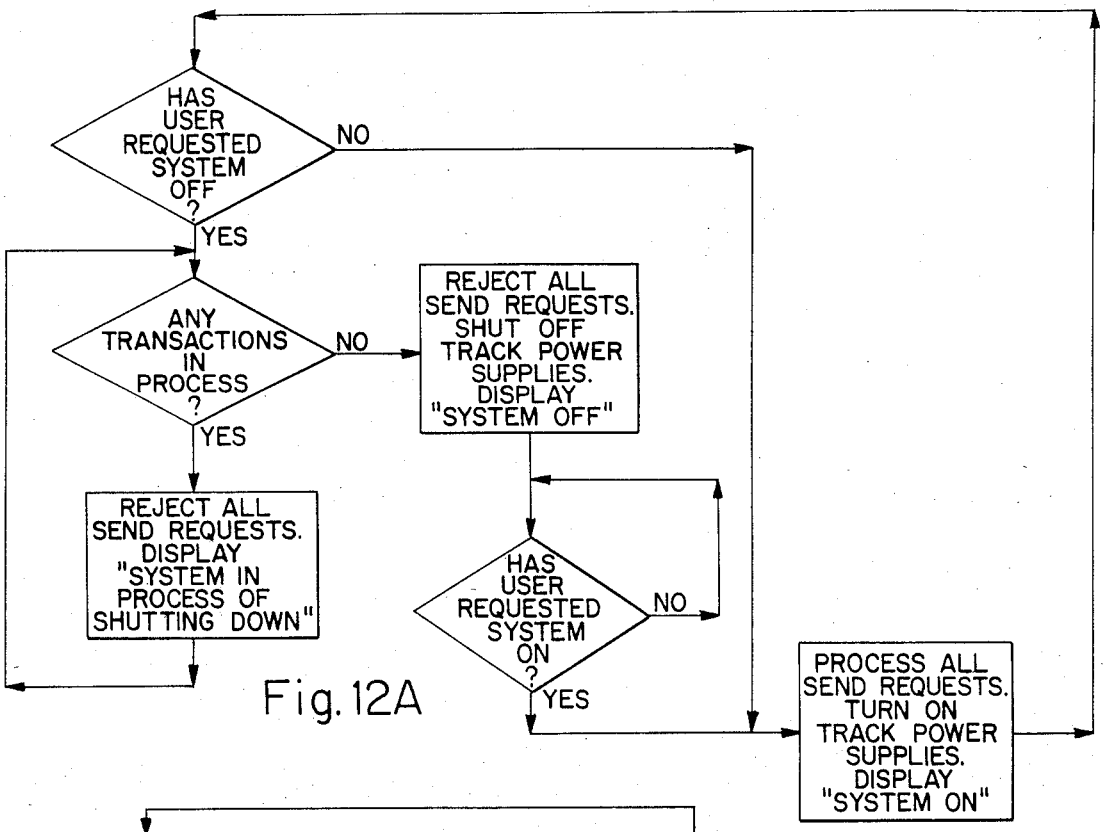
FIGS. 12A–12D are flow charts illustrating certain controlling and monitoring features associated with the present invention.
Figure 12B:
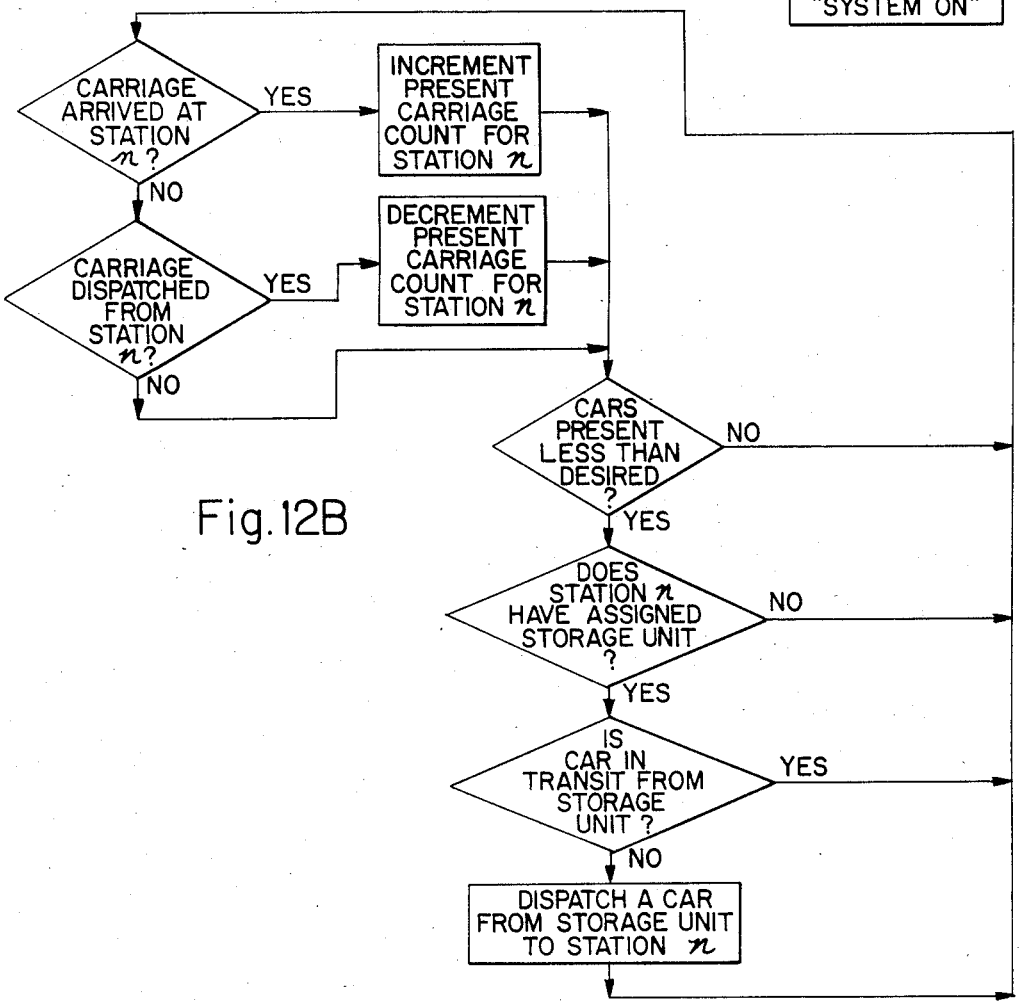
Figure 12C:
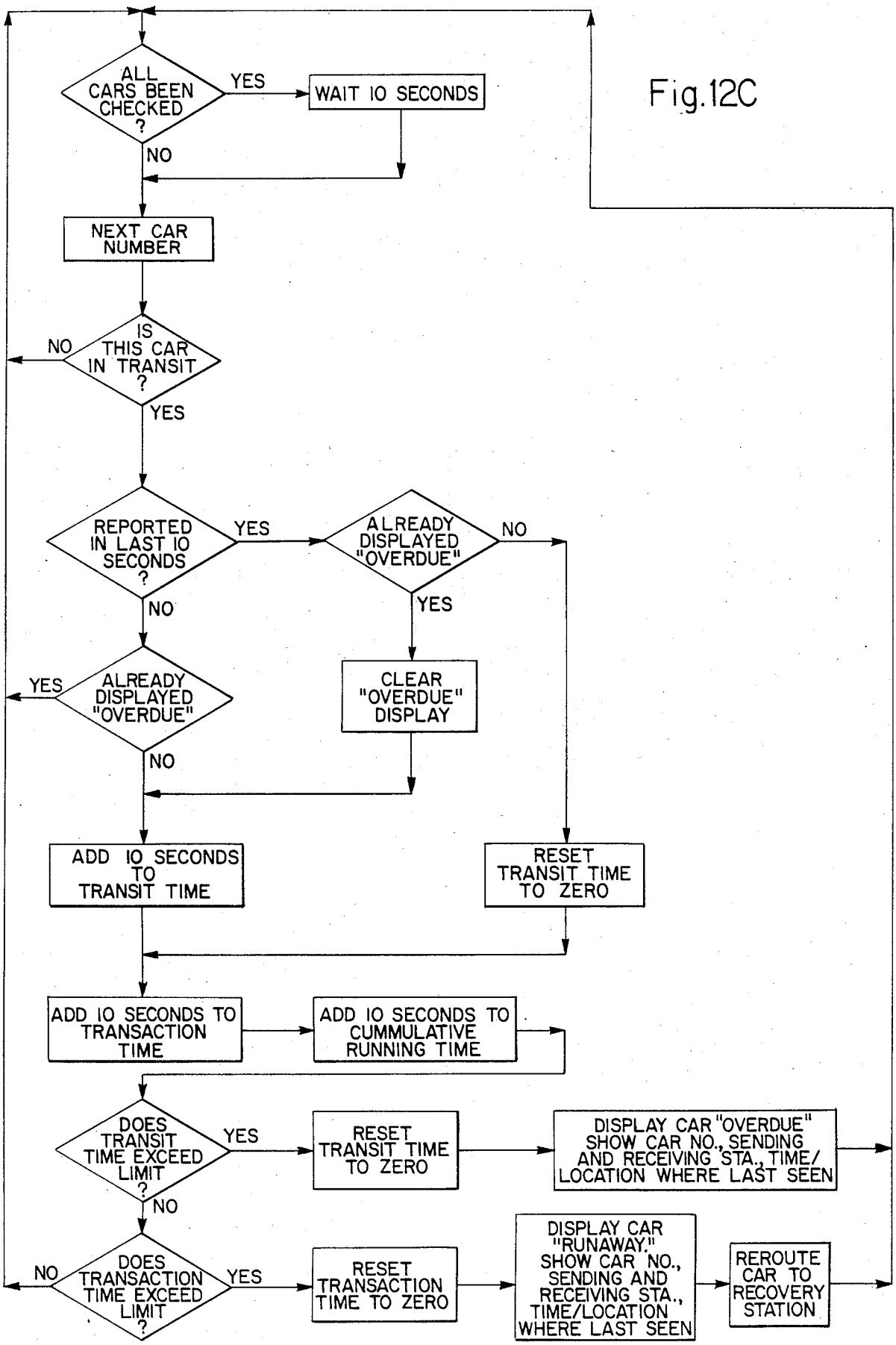
Figure 12D:
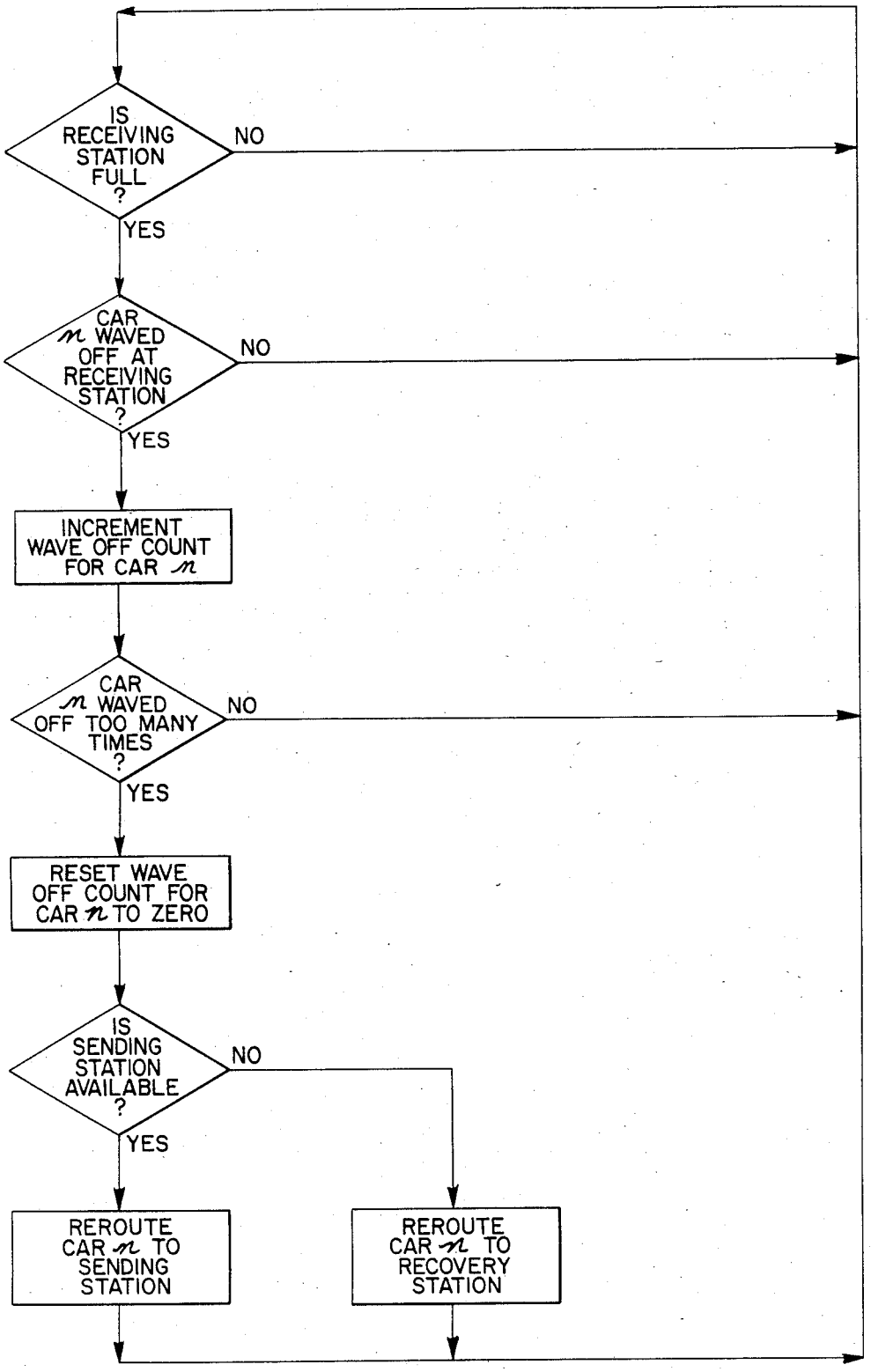

In describing the operation of the conveying system, reference is now made to FIG. 10, which diagrammatically represents an embodiment of the present invention. In this embodiment, six stations are provided for sending and/or receiving cars 10, each of the stations A–F has a station control unit 28*a*–28*f* associated therewith. Nine transfer units 22*a*–22*i* are utilized in this embodiment of the invention. For each transfer unit 22*a*–22*i*, an associated transfer unit controller 30*a*–30*i* communicates therewith for controlling and monitoring purposes as previously discussed.

Some of the transfer units 22 provide different functions. The transfer units 22*e* and 22*i* serve only to reverse traffic at each end of the main track or loop 14. That is, each car 10 entering transfer units 22*e* and 22*i* is transferred by the movable track 26*e*, 26*i*, respectively, to another section of the main track 14 in order to reverse the direction of the car 10 entering the transfer units 22*e*, 22*i*.

The transfer units 22*a*, 22*f*, 22*g* are able to direct cars 10 to a reversing track branch 16*a*, 16*d*, 16*e*, respectively. Each of the reversing track branches 16*a*, 16*d*, 16*e* can be used to both carry cars 10 from their respective transfer units 22*a*, 22*f*, 22*g* to their respective stations and from the stations to the connected transfer units 22*a*, 22*f*, 22*g*. That is, the transfer unit 22*a* both sends to and receives cars 10 from the station A over the same reversing track branch 16*a*. The transfer unit 22*f* both sends to and receives cars 10 from the station D over the same reversing track branch 16*d*. In addition, station D is used as a recovery station for certain cars 10. That is, the standard exit of transfer unit 22*f* is to the station D itself. Unless given another exit port, cars 10 entering this transfer unit are sent to the recovery station D for reasons that will be discussed later. The transfer unit 22*g* both sends to and receives cars 10 from station E over the same reversing track branch 16*e*.

In addition to the reversing track branches 16*a*, 16*b*, 16*e*, the system configuration of FIG. 10 also illustrates the use of the one-way or through track branches 16*b*, 16*c*, 16*f*. The through track branches 16*b*, 16*c*, 16*f* direct cars 10 from the transfer units 22*a*, 22*d*, 22*h* in only one direction so that the stations receiving the cars 10 from such transfer unit 22 can only do so in one direction. Specifically, in addition to having a reversing station A joined thereto, the transfer unit 22*a* is also able to direct the cars 10 to station B by means of the through track branch 16*b*. The transfer unit 22*d* also directs cars 10 to a through track branch 16*c* to station C. Similarly, the transfer unit 22*h* is able to direct the cars 10 to a through track branch 16*f* to the station F. In dispatching cars 10 from these through stations B, C, and F, transfer units 22*c* and 22*g* are used in only receiving cars 10 from stations b and f, while transfer unit 22*d* both receives the cars 10 from and sends them to station C.

The transfer unit 22*b* is a special type of transfer unit 22 since it includes two movable tracks 26*b*, 26*b*′ which are capable of moving together in tandem. As a result, the movable track 26*b* shown in FIG. 10 as interconnecting ports 1 and 3 of the transfer unit 22*c* can be moved to interconnect ports 0 and 2 of the same transfer unit 22*b*, while the movable track 26*b*′ illustrated in FIG. 10 interconnecting ports 0 and 2 of the transfer unit 22*c* moves to the position shown by the phantom lines in the area of the transfer unit 22*b*. This functional capability enables the system to transfer a car 10 from the section of the main track 14 directing cars 10 in one direction to the section of the main track 14 which moves cars 10 in the opposite direction. Such a configuration allows the system, in certain situations, to reduce the travel distance and time it takes to move a car 10 from one station to another. By way of example, a car 10 sent from station A to station E would be transferred by the movable track 26*b* interconnecting ports 1 and 3 to the portion of the main track 14 directing cars from right-to-left for entry into the transfer unit 22*g* so that it can be directed to station E. This feature provided by the transfer unit 22*b* avoids directing the car 10 through the transfer units 22*c*, 22*d*, 22*e*, 22*f* in order to reach station E.

Although the main track 14 shown in the embodiment of FIG. 10 illustrates a pair of parallel tracks with transfer units 22*e* and 22*i* at either end to reverse the flow of the cars 10, the parallel track sections making up the track 14 could be widely separated and transfer units 22*e* and 22*i* could be eliminated by using curved track sections at both ends to make 180° turns, so that the entire main track 14 forms a loop.

It should also be understood that transfer units 22 could also be installed to provide branches off the main track 14 to other secondary tracks or loops, which lead to further track branches and stations. The principles associated with controlling movement of the cars 10 are the same regardless of how many secondary tracks or loops are used in the conveying system, so long as it is possible for the cars 10 to find a path to all such secondary tracks and back to the main track 14.

In connection with preparing the conveying system for operation, the system controller 34 is further configured in that a route or path matrix 110 is formed and stored in the memory of the system controller 34. In respect to the embodiment of FIG. 10, a route matrix 110 is illustrated in FIG. 11. The route matrix 110 correlates all possible receiving or destination stations A–F with the transfer units 22*a*–22*i*. Each of the stations A–F of the system of FIG. 11 are identified in the left-hand column of the matrix 110 while each of the transfer units 22*a*–22*i* are identified in the top row of the matrix. In storing the necessary path information in the route matrix 110, the identity of the exit ports, to be taken by a car 10 as it passes through one or more of the identified transfer units 22*a*–22*i*, is provided in the same row as the identified destination station. The port numbers (0–3) provided in FIG. 11 are port numbers other than standard exit port numbers since each of the transfer unit controllers 30 will direct any car 10 to its standard exit port, unless another exit is identified for the car 10 traveling to the desired destination or receiving station. The route matrix 110 is arrived at by determining the minimum path a car 10 should take to reach its receiving station and identifying the transfer units 22 that the car 10 comes in contact with, for which the exit port is other than the standard exit port. The route matrix 110 is formed without regard to the identity of the particular sending station.

With reference to FIG. 10 also, a car 10 destined for station B, in cases in which it must pass through the transfer unit 22*f*, instead of taking the designated standard exit port 2, the transfer unit controller 30*f* would control the movable track 26*f* of the transfer unit 22*f* so that the car 10 exits port 1 of the transfer unit 22*f*. Similarly, if the car 10 moves into the area associated with the transfer unit 22*b* from a right-to-left direction, the transfer unit controller 30*b* would cause the car to exit port 0, rather than the standard exit port 3. Also, when the car 10 is about to enter the destination station B, the transfer unit 22*a* associated therewith is controlled so that the car 10 does not exit the standard exit port 2, but instead is transferred to port 3 for exiting to the station B. With respect to any other transfer units 22 that the car 10 might enter during its path to the destination station B, the associated transfer unit controllers 30 control the movement thereof by permitting the car 10 to exit the standard exit port associated with the particular transfer unit 22 which is encountered by the car 10.

To further understand the movement of a car 10 from a sending station to a receiving station, an example of a car transaction is next described. Assume that station B has a car 10 that is to be sent to station E. The identity of the address of the receiving station E is inputted to the station control unit 28*b* by the user. This information is received by the transfer unit controller 30*a*, which is the associated transfer unit controller for station B for communicating the information to the system controller 34. If the receiving station E is able to receive the car 10, the system controller 34 informs the transfer unit controller 30*a* to proceed with the dispatching of the car 10. As the car 10 leaves station B, its car identification number is read or determined using a read/detect rail 106, which is located at the exit area of station B and identified by the dot on FIG. 10. The car identification number is communicated to the system controller 34 by the transfer unit controller 30*a*, together with the identity of the sending address for station B. For this example, further assume that the conveying system of FIG. 10 is able to handle a total of sixteen cars 10 and the car identification number is 13 for the car 10 which is being sent to the receiving station E. The system controller 34 accesses its route matrix 110 to determine the desired path to station E for car no. 13. With the receiving station being E, the system controller 34 instructs the transfer unit controller 30*b* to send the car 10 having the identification number 13 to port 0 as its exit port for the transfer unit 22*b*. Similarly, the system controller 34 instructs the transfer unit controllers 30*f*, 30*g* so that the identified car no. 13 will take ports 1, 2, respectively as its exits from the transfer units 22*f*, 22*g*. The transfer unit controller 22*g* is also informed that car no. 13 will arrive at station E when it exits port 2 of the transfer unit 22*g*. The car no. 13 will also encounter transfer units 22*c*, 22*d* and 22*e* on its path to station E. With respect to each of the transfer units 22*c*–22*e*, the associated transfer unit controllers 30*c*–30*e*. will direct car no. 13 to the standard exit (SX) port for the particular transfer unit 22.

In conjunction with receiving the exit instructions from the system controller 34, the transfer unit controllers 30*b*, 30*f*, 30*g* store the exit port number in their exit instruction table 40 in the memory location designated for car no. 13. The transfer unit controllers 30*c*, 30*d*, and 30*e*, have stored, in their route instruction tables 40 in the memory location for car no. 13, a default code which represents the standard exit port for their associated transfer unit 22.

As car no. 13 leaves station B, the transfer unit controller 30*a* will send a polling reply concerning car no. 13 to the system controller 34 in response to the polling message of the system controller 34. This polling reply includes certain of the bytes of information illustrated in FIG. 4 and particularly includes the car identification no. 13 as byte 4, the receiving address station E as byte 6, and the transfer unit identity 22*a* as byte 1. When the car no. 13 reaches transfer unit 22*c*, transfer unit controller 30*c* accesses its exit instruction table 40 and determines that it is to send car no. 13 out of its standard exit port 2 onto the main track 14. This determination is made by interrogating route flag bit 6 in the location for car no. 13. When bit 6 is a logic low, the transfer unit controller 30*c* recognizes that the car no. 13 is to take the standard exit port. The transfer unit controller 30*c* also sends a polling reply in response to a polling message, in particular, the polling reply includes bytes 3 and 4 of FIG. 4 in which the system controller 34 is informed that car no. 13 was sighted by this transfer unit. Likewise, the transfer unit controllers 30*d*, 30*e* control their corresponding transfer units 22*d*, 22*e* such that car no. 13 exits their standard exit ports, namely, port 2 and port 0, respectively, after accessing the exit instruction tables 40 in their memories to determine the exit port number for car no. 13.

With respect to the transfer units 22*f*, 22*b*, the associated transfer unit controllers 30*f*, 30*b* determine from their exit instruction tables 40 in the memory location for car no. 13 that the exit ports are not the standard exit ports, but rather are ports 1, 0, respectively. As a consequence, the transfer unit controllers 30*f*, 30*b* control their respective transfer units 22*f*, 22*b* so that the movable tracks 26*f*, 26*b* thereof are positioned to direct car no. 13 to these identified exit ports.

When car no. 13 arrives at the transfer unit 22*g*, the exit instruction table 40 stored in the transfer unit controller 30*g* for car no. 13 indicates that it is to be directed to port 2, which is an arrival at the destination station E. When car no. 13 is identified by the transfer unit controller 30*g* at the entrance to station E using a read/detect rail 106, the information relating to its arrival is communicated to the system controller 34. The system controller 34 has been monitoring the car transaction throughout the entire movement of car no. 13 using the polling message and reply format illustrated in FIGS. 2 and 4. With the car transaction completed, the system controller 34 deletes the transaction from its active file and instructs the transfer unit controllers 30*b*, 30*f*, 30*g* to replace their instructions in their exit instruction tables 40 for car no. 13 with information indicating the identity of the standard exit port for the transfer unit 22 associated with these transfer unit controllers 30.

A further example of the operation of the embodiment shown in FIG. 10 is next given illustrating the interaction between two cars 10 during their movement to and from the same transfer unit 22. In this example two cars 10 having car identification nos. 7 and 12 are to encounter transfer unit 22*a*. Assume that the destination for car no. 7 is station C while the destination of car no. 12 is station A, which is linked to the transfer unit 22*a* by the reversing track branch 16*a*. Further assume that car no. 7 is moving ahead of car no. 12. With reference to FIG. 9, when car no. 7 reaches the stop/detect rail 104 on the main track 14 at the entry to port 0, the transfer unit controller 30*a*, using its car detecting and controlling circuit 76, detects the presence of car no. 7 and provides a stop signal on the other stop/detect control rails 104, which are located at the other entrances to the transfer unit 22*a*. Since the only other entry port for transfer unit 22*a* is port 1, the transfer unit controller 30*a* causes a stop to be placed on the stop/detect rail 104 located at the entry to port 1 of the transfer unit 22*a*. Since the transfer units 22 can only process one car 10 at a time, the stop control signal prevents any other car 10 from entering the transfer unit 22*a* while car no. 7 is being processed. As a result, any car 10 being dispatched from station A to the transfer unit 22*b* would be stopped at the stop/detect control rail 104 located at port 1.

When car no. 7 reaches the read/detect rail 106 located at the entry to port 0, the transfer unit controller 30*a* also provides a stop signal on the stop/detect rail 104 from which car no. 7 just left so that car no. 12 will be stopped on this stop/detect rail 104 while car no. 7 is being processed. As previously discussed in connection with car no. 13, the transfer unit controller 22*a* determines the car identification number for car no. 7 using the read/detect rail 106 located at port 0 and the car transmitter circuit 44 and the transfer unit controller reader circuit 52. The transfer unit controller 22*a* accesses its exit instruction table 40 to determine the exit port to be taken by car no. 7. Since car no. 7 is destined for station C, car no. 7 is to take the standard exit port. This information is provided by the route flag bit for car no. 7 in the route instruction table. That is, bit 6 is a logic low so that the transfer unit controller 22*a* recognizes that car no. 7 is to be sent out the standard exit port. Since the movable track 26*a* is already aligned between ports 0 and 2, the rest or standby position, car no. 7 never stops moving and exits port 2. From port 2 of the transfer unit 22*a*, car no. 7 continues its movement to the transfer unit 22*c* on its way to station C.

Before the transfer unit controller 30*a* considers the processing of car no. 7 to be complete, it waits until car no. 7 is completely clear of the transfer unit 22*a*, as indicated by detecting it leaving the read/detect rail 106, which is located past the exit port 2. With the processing of car no. 7 finished, the transfer unit controller 30*a* then checks all its entrances namely ports 0 and 1, to determine if one or more cars 10 arrived while car no. 7 was being processed. If more than one car 10 is detected, they are processed one at a time. In this example, the transfer unit controller 30*a* determines that a car 10 is being held on the stop/detect rail 104, which is located at the entry to port 0 for the transfer unit 22*a*. The transfer unit controller 30*a* removes the stop signal applied to the stop/detect rail 104 so that car no. 12 can continue its movement into port 0 and onto the movable track 26*a*. When the car no. 12 reaches the read/detect rail 106 located at the entry to port 0, the transfer unit controller 30*a* reapplies a stop signal to the stop/detect rail 104 located before the entry to port 0. As with car no. 7, the transfer unit controller 30*a* determines the car identification number for car no. 12. From its determination of the car identification number, the transfer unit controller 30*a* accesses its exit instruction table 40 for car no. 12 and finds an exit instruction indicating that car no. 12 is to take port 1. Because car no. 12 is to be transported using the movable track 26*a*, the transfer unit controller 30*a* provides a stop signal to the stop/detect rail 104 located on the movable track 26*a*. Consequently, when car no. 12 reaches this stop/detect rail 104, the presence of car no. 12 on this rail is detected and its movement stopped. The transfer unit controller 30*a* nexts repositions the movable track 26*a* so that it is aligned with ports 1 and 3 of transfer unit 22*a*. After the movable track 26*a* is in this position, the polarity relay 32 associated with this movable track 26*a* is energized so that car no. 12 will move in a direction opposite to the standard direction. With the polarity relay 32 energized, the transfer unit controller 30*a* then removes the stop signal from the stop/detect rail 104 in contact with car no. 12. As a result, car no. 12 moves toward port 1 off of the movable track 26*a* and passes over detect rail 105 located on the movable track 26*a*, read/detect rail 106 located outside the movable track 26*a* at the entry/exit to port 1, and the stop/detect rail 104 which is located outside the movable track 26*a* at the entry/exit to port 1. When car no. 12 reaches this stop/detect rail 104, the transfer unit controller 30*a* recognizes that car no. 12 is clear of the transfer unit 22*a*. At this time, the transfer unit controller 30*a* causes the movable track 26*a* to be moved to its rest or standby position and de-energizes the polarity relay 32 associated therewith to restore the standard polarity in which cars 10 are able to move from left-to-right direction across the movable track 26*a*. The transfer unit controller 30*a* then scans the entrance ports 0 and 1 again, looking for another car 10 to process.

In the case of a user desiring to dispatch a car 10 from station A after car no. 12 has been detected by the transfer unit controller 30*a*, the system controller 34 will postpone processing of the send request transmitted by the transfer unit controller 30*a* from the station control unit 28*a*. Only after the system controller 34 has determined that the car 10 to be dispatched from station A is the next car 10 in line for entry to the transfer unit 22*a* will a pending send request from station control unit 28*a* be processed.

A further control feature provided by the system controller 34 relates to preventing the dispatch of additional cars 10 into the conveying system. When desired, the system controller 34 is accessed by the user and instructed that no more cars 10 are to be permitted to be dispatched from any of the stations. The system controller 34 then rejects any send request sent by a station control unit 28 but it permits all cars 10 already being transported in the system to reach a destination station.

In addition to controlling the movement of the cars 10 throughout the conveying system, the system controller 34 can also provide a number of monitoring functions. A first monitoring feature relates to the amount of time taken by a car 10 to move from one transfer unit 22 to another transfer unit 22. To provide a check on whether cars 10 are moving properly along the main track 14 to their destination addresses, the system controller determines whether a car 10 is taking too much time in transit between adjacent transfer units 22. To accomplish this monitoring objective, the system controller 34 stores in its memory information relating to the car transaction in progress. This information includes, among other things, the identity of the sending and receiving stations for the car 10, the car identification number, and a time measurement related to the transit time of the car 10. In particular, the system controller 34 keeps track of the amount of elapsed time between transfer units 22 for each car 10. This is accomplished by resetting a timer to zero in the system controller 34 when a car 10 leaves a transfer unit 22. The system controller 34 continuously compares the magnitude of this running time of the car 10 with a predetermined maximum value. If the running time of the car 10 between transfer units 22 exceeds this predetermined time value, the system controller 34 provides an indication to the user that there is probably a problem with the car 10 and corrective action should be taken regarding the particular identified car 10. The predetermined maximum time value is typically selected to be a magnitude somewhat greater than the amount of time that a car 10 should take to travel the farthest distance between any two transfer units 22, detect rails 18, control rails 24, or a combination thereof in the system.

Related to the feature of monitoring the time between transfer units 22 or the control rails 24, is the ability of the system controller 34 to provide the user with the last reported location of a car 10, whose traveling time exceeded the predetermined maximum value. This is accomplished by the system controller 34 keeping track of the last transfer unit 22 encountered by the car 10 before it was found that its transit time exceeded the predetermined maximum time. As a result, the user can take appropriate action regarding such a car 10, possibly depending upon the identification number of the car 10, as well as its sending and receiving destination.

A second monitoring feature also relates to a timing operation performed by the system controller 34. In this second timing feature, the system controller 34 keeps track of the amount of time that has elapsed from the time a car 10 left its sending station (current car transaction time). The system controller 34 resets the time associated with this operation to zero when the monitored car 10 enters the conveying system. A running time is kept for the car 10 during the time that the car transaction is taking place. If the monitored time exceeds a predetermined maximum time value, the system controller 34 provides an indication of this car failure. This predetermined maximum time is selected to be somewhat greater than the maximum expected time a car 10 should take in moving from any sending station to any receiving station located in the conveying system.

This second feature protects against certain kinds of failures that might otherwise go undetected. Using the previous example involving car no. 13, assume that the transfer unit 22*g*, for some reason, did not have the proper exit instruction for car no. 13 but instead had route information whereby car no. 13 is sent out its standard exit port. In such a case, car no. 13 would circulate continuously through the transfer units 22*a*, 22*b*, 22*g*, 22*h*, and 22*i* while continually reporting its location to the system controller 34 at each of these transfer units 22. Using the second timing feature, the system controller 34 is able to detect that the maximum allowable car transaction time has been exceeded and corrective action should be taken with respect to car no. 13.

Related to this second timing feature, the system controller 34 has a routine for rerouting a car 10 in which the maximum transaction time has been exceeded. The system controller 34 is able to send the car 10 back to its sending station using the sending station address which it has kept in its memory. Alternatively, as previously discussed, the present invention includes the recovery station D to which a car 10 may be sent by the system controller 34. The station D was designated as the recovery station for receiving cars 10 when such a situation as just described occurs.

A third timing feature provided by the system controller 34 concerns the total time spent by a car 10 moving in the conveying system. The total time for each car 10 is a summation of all car transaction times for that car 10. This feature provides the user with information that is useful in determining whether cars 10 are scheduled for maintenance or whether a particular car 10 may not be performing according to reasonable standards.

A further monitoring feature of the present invention relates to the controlling of the movement of the cars 10 wherein a car 10 is not permitted to enter its designated receiving station because that receiving station has become overloaded with other cars 10. The overload is detected by the associated transfer unit 30 by means of an appropriately located rail at the station. When a car 10 is on such a rail, it is an indication that the station is full of cars 10 and cannot receive additional cars 10. In such an instance, the associated transfer unit controller 30 waves off or does not permit another car 10 to enter the full station. The waved off car 10 then continues its movement and eventually comes back to its desired destination. If the station continues to be overloaded with cars 10, the transfer unit controller 30 continues to wave off the car 10 from its desired destination. The system controller 34 is also involved as it keeps track of the number of times that the particular car 10 has been waved off or not allowed to enter its destination station. From a predetermined number previously inputted to the system controller 34 and comparing that number with the number of times that the car 10 has been waved off, the system controller 34 can make a determination as to whether the car 10 should be permitted to continue its movement in the conveying system. If the maximum value of wave offs is exceeded, the system controller 34 can automatically take appropriate action. For example, the system controller 34 can provide the necessary instructions to the appropriate transfer unit controllers 30 to send the car 10 back to its sending station, or route the car 10 to the recovery station.

The system controller 34 provides a further monitoring feature relating to maintaining a predetermined number of cars 10 at each of the system stations. With respect to this feature, the system controller 34 keeps track of the number of cars 10 present at a station and compares that number with a predetermined minimum number of cars 10, which are expected to be at the particular station. If the actual number of cars 10 is less than the predetermined minimum number of cars 10 at a particular station, the system controller 34 automatically initiates control to send a desired number of cars 10 to the station having a deficient number thereof. In one embodiment, the system controller 34 initiates movement of the desired number of cars 10 from a storage station and instructs the appropriate transfer unit controllers 30 regarding the cars 10 which are being dispatched to that station which has less than the predetermined desired number of cars 10.

In addition to the controlling and monitoring functions, the system controller 34 also is able to provide a visual display of important information associated with car transactions using its display unit 38. By means of the keyboard 36, the user or operator selects the desired information to be displayed. Such information includes a display relating to all car transactions in progress including the identification numbers of the cars 10 and the identify of their sending and receiving stations, a display of the transit, transaction, and total running times for each of the cars 10, a display relating to the last reported location of each car 10, and displays associated with the status of each of the stations and transfer units 22, such status information including whether or not a send request is being sent by a particular station and whether the SE and SX ports of a particular transfer unit 22 are busy processing a car 10.

Flow charts are provided in FIGS. 12A–12D to further illustrate the aforedescribed controlling and monitoring features associated with the programmed system controller 34.

Although the present invention has been described with reference to a particular embodiment, it is readily understood that variations and modifications can be effected within the spirit and scope of the invention.

What is claimed is:

1. A method for controlling movement of one or more carriages along a track using digital circuitry, comprising:

providing a plurality of carriages and a track along which said carriages can move;

providing each of said carriages with an identifier different from the identifiers of the other of said plurality of carriages;

selecting a receiving address for one of said carriages located at a sending address;

moving said one carriage along the track from said sending address;

determining the path to be taken by said one carriage using the identifier of said one carriage; and controlling the movement of said one carriage, including monitoring the position of said one carriage along the track as said one carriage moves towards its receiving address so that a fault relating to said carriage not reaching its receiving address is known and the approximate location of said carriage can be determined.

2. A method, as claimed in claim 1, wherein:

said determining step includes transmitting a signal relating to the identifier of said one carriage using a section of track over which said one carriage moves, receiving said transmitted signal, and decoding said transmitted signal to determine the identifier of said one carriage.

3. A method, as claimed in claim 1, wherein:

said determining step includes detecting the presence of said one carriage and reading the identifier of said one carriage at the same time.

4. A method, as claimed in claim 1, wherein:

said determining step includes providing a desired path for said one carriage to said receiving address, said desired path not depending upon said sending address.

5. A method, as claimed in claim 1, wherein:

said controlling step includes the step of stopping movement of at least one of the other of said plurality of carriages during the movement of said one carriage.

6. A method, as claimed in claim 1, wherein:

said determining step includes, at predetermined locations along the track, determining which one of at least two separate paths said one carriage is to take using said one carriage identifier and said receiving address.

7. A method, as claimed in claim 1, further including the steps of:

causing movement of all of said plurality of carriages from one or more sending addresses; and retaining in memory said sending addresses for each of said carriages so that one or more of said carriages is able to return to its sending address when desired.

8. A method, as claimed in claim 1, further including the step of:

inhibiting movement of said one carriage at said sending address if its receiving address is unavailable.

9. A method for controlling movement of one or more carriages along a track using digital circuitry, comprising:

providing a plurality of carriages and a track along which said carriages can move;

providing each of said carriages with an identifier different from the identifiers of the other of said plurality of carriages;

selecting a receiving address for one of said carriages located at a sending address;

moving said one carriage along the track from said sending address;

determining the path to be taken by said one carriage using the identifier of said one carriage; and controlling the movement of said one carriage, including changing said receiving address of said one carriage at some location along the track when said receiving address is not available.

10. A method for controlling movement of one or more carriages along a track using digital circuitry, comprising:

providing a plurality of carriages and a track along which said carriages can move;

providing each of said carriages with an identifier different from the identifiers of the other of said plurality of carriages;

selecting a receiving address for one of said carriages located at a sending address;

moving said one carriage along the track from said sending address;

determining the path to be taken by said one carriage using the identifier of said one carriage;

controlling the movement of said one carriage; and monitoring the amount of transaction time said one carriage has been moving from the time it left said sending address.

11. A method for controlling movement of one or more carriages along a track using digital circuitry, comprising:

providing a plurality of carriages and a track along which said carriages can move;

providng each of said carriages with an identifier different from the identifiers of the other of said plurality of carriages;

selecting a receiving address for one of said carriages located at a sending address;

moving said one carriage along the track from said sending address;

determining the path to be taken by said one carriage using the identifier of said one carriage;

controlling the movement of said carriage; and monitoring the amount of total time said one carriage has been moving along the track by using a plurality of transaction times.

12. A method for controlling movement of one or more carriages along a track using digital circuitry, comprising:

providing a plurality of carriages and a track along which said carriages can move;

providing each of said carriages with an identifier different from the identifiers of the other of said plurality of carriages;

selecting a receiving address for one of said carriages located at a sending address;

moving said one carriage along the track from said sending address;

determining the path to be taken by said one carriage using the identifier of said one carriage;

controlling the movement of said one carriage; and providng a recovery address for said one carriage for receiving said one carriage when its receiving address is unavailable.

13. A method for controlling movement of one or more carriages along a track using digital circuitry, comprising:

providing a plurality of carriages and a track along which said carriages can move;

providing each of said carriages with an identifier different from the identifiers of the other of said plurality of carriages;

selecting a receiving address for one of said carriages located at a sending address;

moving said one carriage along the track from said sending address;

determining the path to be taken by said one carriage using the identifier of said one carriage;

controlling the movement of said one carriage; and preventing carriages from leaving sending addresses while, at the same time, permitting carriages already moving along the track to continue to their receiving addresses.

14. A method for controlling movement of one or more carriages along a track using digital circuitry, comprising:

providng a plurality of carriages and a track along which said carriages can move;

providing each of said carriages with an identifier different from the identifiers of the other of said plurality of carriages;

selecting a receiving address for one of said carriages located at a sending address;

moving said one carriage along the track from said sending address;

determining the path to be taken by said one carriage using the identifier of said one carriage;

controlling the movement of said one carriage;

monitoring the number of carriages located at said sending address;

comparing the actual number of said carriages at said sending address with a predetermined number; and providing carriages automatically to said sending address when the actual number of said carriages is less than said predetermined number.

15. A method for controlling movement of one or more carriages along a track using digital circuitry, comprising:

providing a plurality of carriages and a track along which said carriages can move;

providing each of said carriages with an identifier different from the identifiers of the other of said plurality of carriages;

selecting a receiving address for one of said carriages located at a sending address;

moving said one carriage along the track from said sending address;

determining the path to be taken by said one carriage using the identifer of said one carriage; and controlling the movement of said one carriage, including automatically transporting said one carriage to a predetermined address when the identifier of said carriage cannot be determined.

16. A method for conveying a carriage along track from a sending address to a receiving address using a system controller, a plurality of transfer unit controllers, a number of station control units, and a number of transfer units having a number of ports, comprising:

providing a carriage with an identifier;

selecting a receiving address for said carriage using a station control unit;

informing said system controller of said receiving address and said identifier of the carriage;

communicating the identity of a port to be taken by said carriage to at least one of said transfer unit controllers;

moving said carriage along the track;

determining the desired path of said carriage using said carriage identifier as said carriage moves along the track;

using transfer units to provide the desired track path of said carriage; and stopping said carriage at said receiving address.

17. A method, as claimed in claim 16, wherein:

said informing step is provided by a transfer unit controller in response to a polling request from said system controller.

18. A method, as claimed in claim 17, wherein:

said polling message provided by said system controller is serially sent to each of said transfer unit controllers.

19. A method, as claimed in claim 16, further including the step of:

storing in said said system controller a desired path for said carriage relating to said transfer units, said desired path depending upon said receiving address of said carriage.

20. A method, as claimed in claim 19, wherein:

said desired path is independent of said sending address.

21. A method, as claimed in claim 16, further including the steps of:

providing a plurality of carriages;

receiving a first carriage into a first transfer unit of said plurality of transfer units;

preventing movement of the other of said plurality of carriages into said first transfer unit while said first transfer unit is processing said first carriage.

22. An apparatus for conveying material between a sending address and a receiving address, comprising:

station means located adjacent to a sending address for inputting a receiving address;

carriage means provided adjacent to said station means for transporting materials, said carriage means having an identifier;

track means supporting said carriage means and for use in moving said carriage means; and control means communicating with said station means and said carriage means for monitoring said carriage means using said carriage means identifier, said control means also controlling the movement of said carriage means to said receiving address, said control means including means for monitoring the time said carriage means moves on said track means.

23. An apparatus, as claimed in claim 22, wherein:

said control means includes means for displaying said identifier of said carriage means and the approximate location of said carriage means on said track means.

24. An apparatus, as claimed in claim 22, wherein said control means includes:

transfer unit means having a section of track which is movable between a first position and a second position.

25. An apparatus, as claimed in claim 24, wherein said control means further includes:

transfer unit control means operatively connected to said transfer unit means for use in determining said identifier of said carriage means and for storing information associated with the path to be taken by said carriage means.

26. An apparatus, as claimed in claim 25, wherein said control means further includes:

system control means communicating with said transfer unit control means and for use in determining a path to be taken by said carriage means, and for communicating information relating to said desired path to said transfer unit control means.

27. An apparatus, as claimed in claim 22, wherein:

said carriage means includes means for providing said identifier to said carriage means.

28. An apparatus, as claimed in claim 22, wherein:

said control means is responsive to said station means and includes means for preventing said carriage means from leaving said sending address.

29. An apparatus, as claimed in claim 25, wherein:

said transfer unit control means includes storage means for storing information relating to the path to be taken by said carriage means through said transfer unit means.

30. An apparatus, as claimed in claim 29, wherein:

said carriage means includes a plurality of carriages, each of said plurality of carriages having an identifier, and said storage means of said transfer unit control means having a memory location associated with each of said plurality of carriages.

31. An apparatus, as claimed in claim 26, wherein:

said system control means includes storage means for storing information relating to the path to be taken by said carriage means, said path depending upon said receiving address but being independent of said sending address.

32. An apparatus, as claimed in claim 22, wherein:

said carriage means includes transmitter means for transmitting a transmitter signal relating to said carriage means identifier.

33. An apparatus, as claimed in claim 32, wherein:

said track means includes control rails responsive to said carriage means for receiving said transmitter signal from said transmitter means.

34. An apparatus, as claimed in claim 33, wherein:

said control means includes reader means responsive to said transmitter means and said control rails for use in determining the identifier of said carriage means.

35. An apparatus, as claimed in claim 25, wherein:

said transfer unit control means includes carriage detecting and controlling means in communication with said control rails for detecting the presence of said carriage means.

36. An apparatus for conveying material between a sending address and a receiving address, comprising:

station means located adjacent to a sending address for inputting a receiving address;

carriage means provided adjacent to said station means for transporting materials, said carriage means having an identifier;

track means supporting said carriage means and for use in moving said carriage means; and control means communicating with said station means and said carriage means for monitoring said carriage means using said carriage means identifier, said control means also controlling the movement of said earriage means to said receiving address, said control means including transfer unit means having a section of track which is movable between a first position and a second position, said transfer unit means including a number of control rails, at least a first control rail being used in detecting the presence of said carriage means, and at least a second control rail being used for stopping said carriage means while in contact with said second control rail.

37. An apparatus for conveying material between a sending address and a receiving address, comprising:

station means located adjacent to a sending address for inputting a receiving address;

carriage means provided adjacent to said station means for transporting materials, said carriage means having an identifier;

track means supporting said carriage means and for use in moving said carriage means; and control means communicating with said station means and said carriage means for monitoring said carriage means using said carriage means identifier, said control means also controlling the movement of said carriage means to said receiving address, said control means incuding at least two transfer unit means, and said control means monitors the amount of time taken by said carriage means to move between said two transfer unit means.

38. An apparatus for conveying material between a sending address and a receiving address, comprising:

station means located adjacent to a sending address for inputting a receiving address;

carriage means provided adjacent to said station means for transporting material, said carriage means havng an identifer, said carriage means including a plurality of carriages, said station means has a predetermined number of carriages associated therewith;

track means supporting said carriage means and for use in moving said carriage means; and control means communicating with said station means and said carriage means for monitoring said carriage means using said carriage means identifier, said control means also controlling the movement of said carriage means to said receiving address, said control means including means for causing at least one of said carriages to be moved to said station means when the number of said carriages at said station means is less than said predetermined number of carriages.

* * * * *